US005172679A

United States Patent [19]

Mussack

[11] Patent Number: 5,172,679

[45] Date of Patent: Dec. 22, 1992

[54] MODULAR CONSTRUCTION FOR COMPOUND ARCHERY BOW

[75] Inventor: Kevin R. Mussack, Clifton Springs, N.Y.

[73] Assignee: Golden Eagle Archery, Inc., Farmington, N.Y.

[21] Appl. No.: 749,312

[22] Filed: Aug. 23, 1991

Related U.S. Application Data

[63] Continuation-in-part of Ser. No. 569,868, Aug. 20, 1990, abandoned.

[51] Int. Cl.[5] ..... F41B 5/00

[52] U.S. Cl. ..... 124/25.6; 124/23.1; 124/88

[58] Field of Search ..... 124/88, 25.6, 23.1, 124/24.1, 86

[56] References Cited

U.S. PATENT DOCUMENTS

| | | | |
|---|---|---|---|
| 3,821,946 | 7/1974 | Griggs | 124/23.1 |
| 3,841,295 | 10/1974 | Hunter | 124/88 X |
| 3,942,506 | 3/1976 | Izuta | 124/88 X |
| 4,064,862 | 12/1977 | Groner | 124/25.6 |
| 4,261,320 | 4/1981 | Barna | 124/88 X |
| 4,574,766 | 3/1986 | Izuta | 124/88 X |

*Primary Examiner*—Peter M. Cuomo
*Attorney, Agent, or Firm*—Hoffman Stone

[57] ABSTRACT

A modular construction for compound archery bows includes sets of spacer blocks for insertion between the bow handle and the limbs. The blocks are shaped to provide selected variations in the geometry of the bows, selectively adjusting the brace height and the overall length of the bow. The manufacturer is enabled to create bows of many different characteristics without investing in dies to produce differently shaped handles, needing only differently shaped spacer blocks.

3 Claims, 2 Drawing Sheets

MODULAR CONSTRUCTION FOR COMPOUND ARCHERY BOW

This application is a continuation-in-part of co-pending application Ser. No. 569,868, filed Aug. 20, 1990, entitled Conversion Assembly for Reducing the Brace Height of a Compound Archery Bow, and now abandoned.

There seems to have developed recently a diversity in the demand for various different types of compound bows, some archers expressing a preference for bows having a low, others for bows having a relatively high brace height, some for relatively short, others for relatively long bows. All this in addition to variations in draw weight and length. The manufacturer is hard put to make, stock, and keep inventory records of all the various combinations. The principal cost and concern in making the various different combinations lies in the bow handles, which in many cases must be tailored to the particular characteristic desired, especially when bow geometry is involved.

Handles for compound bows are relatively expensive because they are fairly massive and they are die cast, and the cost of a die can be justified only if it can be amortized over a large number of handles.

The principal object of the present invention, therefore, is to enable the manufacturer to offer a seemingly endless variety of compound bows of different sizes and characteristics, practically making the customer feel that the bow he buys is custom designed, but avoiding the need for a large number of differently shaped and dimensioned handles.

BRIEF DESCRIPTION

Briefly, according to the invention, spacer blocks of various different shapes are inserted between the distal ends of the bow handles and the limbs to affect the geometry of the bows. The principle characteristics of a compound bow are determined by its geometry and by the resilience of its limbs. The main feature of the geometry is the relation of the limbs to the handle, which controls the overall length and the brace height. By inserting space blocks in accordance with the designer's choice between the handle and the limbs, the geometry may be controlled as desired without the need for making handles of various different shapes and dimensions.

The resilience of the limbs cannot be changed once they are made, but it is widespread practice to make limbs in a wide range of resiliencies, so it is a simple matter to design a compound bow in accordance with the invention, selecting one or more spacer blocks for insertion between each limb and the handle, selecting limbs of the desired resilience, and making the bowstring and cabling of the proper lengths.

DETAILED DESCRIPTION

Representative embodiments of the invention will now be described in detail in conjunction with the drawings, wherein.

Figure 1:
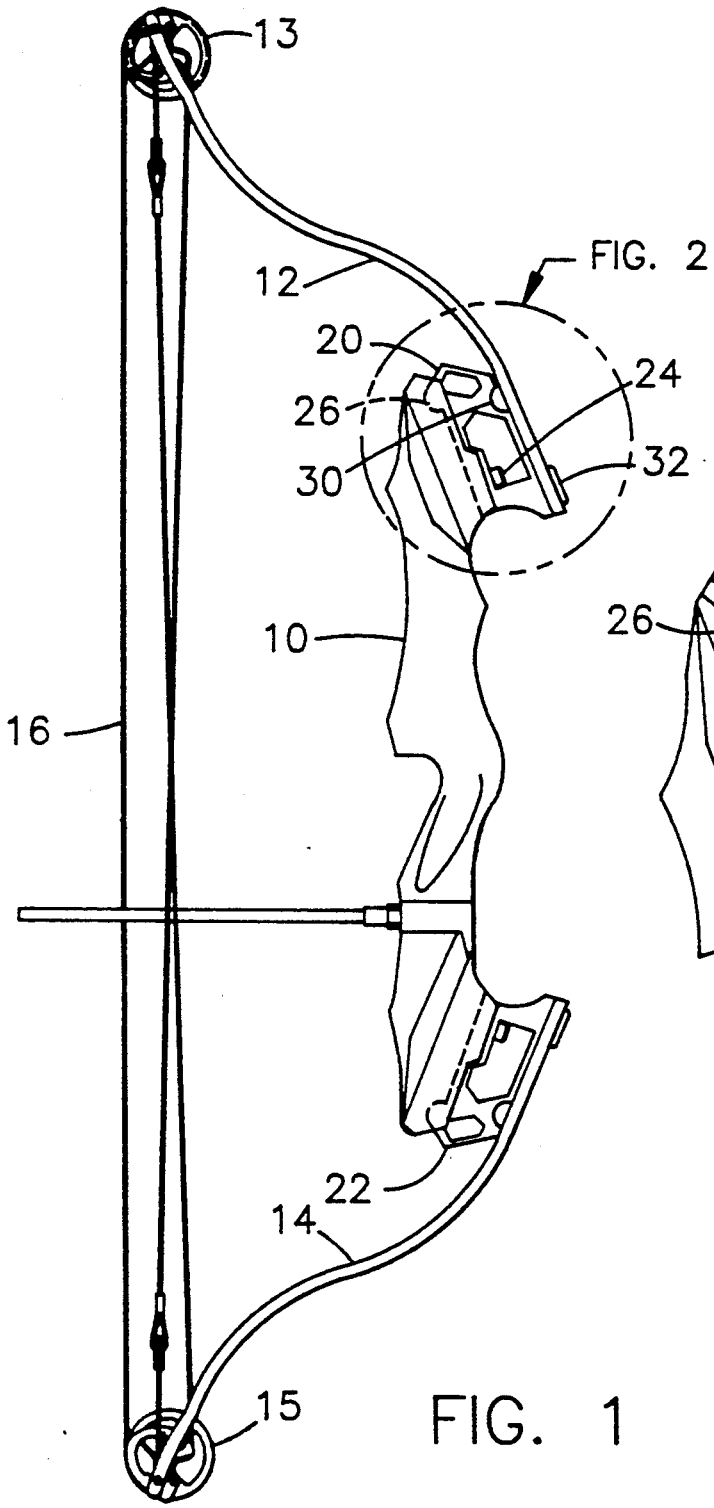
FIG. 1 is a side elevational view of a compound bow in accordance with a first embodiment of the invention, having a lower brace height than the initial design of the bow handle would give.

The invention contemplates a kind of modular construction including a standard handle 10 as shown in FIG. 1, and upper and lower limbs 12 and 14 respectively. Typically, eccentric cam, or wheel and pulley assemblies 13 and 15 are carried at the tips of the limbs 12 and 14 to provide the compound effect, that is, a pronounced let off of the draw weight during the terminal part of the draw. These wheel or pulley assemblies are also made in a large variety of different forms, and a particular form is selected in accordance with the bow characteristics desired.

Figure 2:
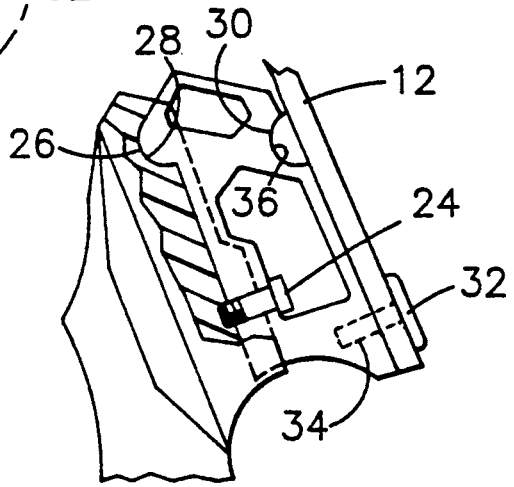
FIG. 2 is an enlarged view, partly in section, of the portion of the bow within the circle 2 of FIG. 1.

In the embodiment shown in FIGS. 1 and 2, the spacer blocks 20 and 22 are designed to reduce the brace height of the bow to a distance less than the original design brace height of the handle 10, assuming standard curvature of the limbs 12 and 14.

The brace height is the distance between the handle 10 and the bowstring 16 when the bow is in its normal, undrawn condition. Heretofore, the market seemed to prefer a brace height of approximately nine inches, more or less, but recently the preference seems to lean toward a height of some seven inches, giving an increase in draw length and arrow velocity. In accordance with the invention, the manufacturer need not invest in a replacement die to make a handle of the shape required for the lower brace height. Instead, using a much smaller, less expensive die, he need only make the spacer blocks 20 and 22, and assemble them between the handle 10 and the limbs 12 and 14 respectively.

The spacer blocks 20 and 22 are shaped to fit between the handle 10 and the limbs 12 and 14, spacing the limbs rearwardly of their original design position relative to the handle, or perhaps it would be better to say that the handle 10 is displaced forwardly toward the bowstring 16. As best seen in FIG. 2, a socket head screw 24 extends through a hole in the front wall of each of the blocks and is threaded in the hole that normally accepts the limb bolt. This screw 24 secures the block to the handle. The block 20 or 22 is stabilized by what may be called a block pivot bar 26 formed integrally with the front wall of the block and lying in a transverse groove 28 that ordinarily accepts a limb pivot bar 30. The limb bolt 32 is threaded in a hole 34 in the rear wall of the block, securing the limb 12 or 14 in place. A transverse grove 36 is formed in the rear wall of the block to receive the limb pivot bar 30.

It should be noted that in this embodiment the spacer blocks 20 and 22 do not simply add thicknesses to the end portions of the handle 10, but are angled to position the handle some two inches closer to the bowstring 16 in the direction normal to the undrawn bowstring without changing the relative positions of the parts in either of the other two orthogonal coordinate directions.

In operation the spacer blocks simulate the forward distal portions of the handle 10, receiving and securing the limbs 12 and 14, and supposing the handle forwardly of the position it would occupy were the limbs secured directly to the handle. The arrangement is convenient and inexpensive. It enables the archer to convert his bow to the modern, high speed style easily and quickly, and it enables the manufacturer to offer both high and low brace height bows at minimum additional investment.

Figure 3:
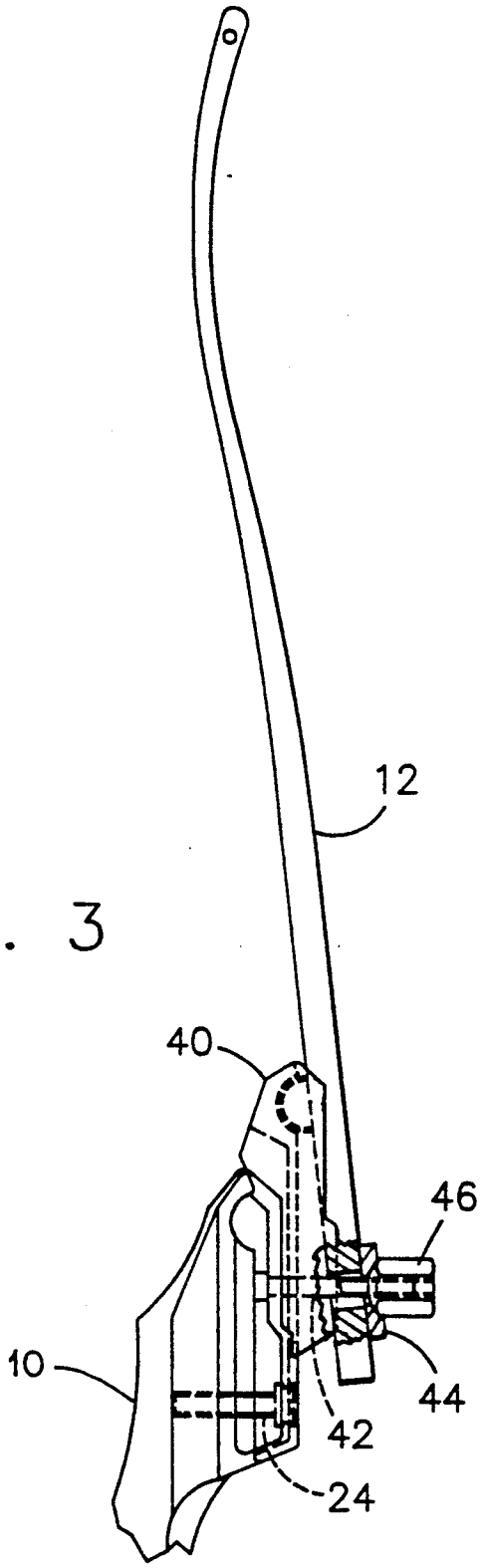
FIG. 3 is a side elevational view of a compound bow in accordance with a second embodiment of the invention, the limbs being spaced outwardly relative to their original design position on the handle making the bow longer than its original design length.
Figure 4:
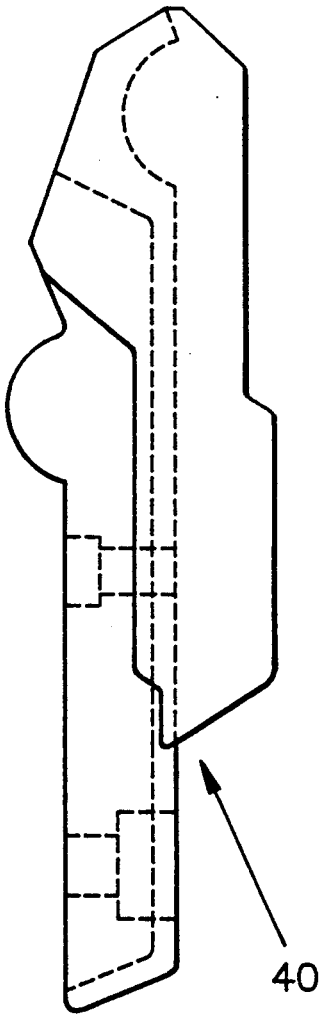
FIG. 4 is a side elevational view of one of the spacer blocks used in the bow shown in FIG. 3.

The spacer block 40 as shown in FIGS. 3 and 4 is designed to extend the length of the bow instead of affecting its brace height. It may be used either by itself or in combination with one of the blocks 20 and 22 shown in FIGS. 1 and 2. In this case, the block 40 rests in the distal end of the handle 10 and is secured on the handle by the usual limb bolt 24. The limb 12 is secured to the block 40 by a blind bolt 42 which passes through the block 40 from its handle side to its front side. A hexagonal hole is formed in the rear face of the block 40 to receive the head of the bolt 42 and hold it against rotation. A washer 44 having a spherically curved face fits over the bolt 42 upon the front of the limb 12, and a retaining nut 46 is threaded on the bolt 42 for securing the limb flush upon the block 40. The retaining nut 46 is also spherically curved to match the curvature of the washer 44, the curvature being designed to accommodate the swing of the limb as it is drawn into its preloaded position during assembly to the handle 10.

What is claimed is:

1. A shim for a compound archery bow having a front face which faces a target when the bow is normally aimed, the bow having a central handle and a pair of limbs fixable upon opposite respective end portions of the handle, a bowstring extending between said pair of limbs, said end-portions of the handle and associated inner surface portions of the limbs forming mating faces shaped to prevent rotation of the limbs relative to the handle when the limbs are secured to the handle, a mating face on said surface portion of each limb being in conforming shape with a mating face on said end portions of the handle, each of the limbs being normally secured directly to an associated shim and the handle by a single screw, said shim comprising a block having front and rear faces, a first transverse above formed in the rear face of said block and being shaped similar to a limb pivot bar on the mating face of one of the bow limbs, and a block pivot bar formed on the front face of said block and being shaped similarly to a second transverse groove in one of the mating faces of the handle, said front and rear faces of said block being spaced from each other a predetermined distance in a predetermined direction so that when a pair of said shims are mounted between the handle and the limbs a distance between two selected parts of the bow is different from an associated distance when the limbs are secured directly to the handle.

2. A shim according to claim 1 wherein the front and rear faces of said block are substantially parallel to each other and are spaced apart in a direction normal to the length of an undrawn bowstring so that the shim reduces the distance between the handle and bowstring or brace height of the bow relative to its brace height when the limbs are fixed directly to the handle.

3. A shim according to claim 1 wherein the front and rear faces of said block are substantially parallel to each other and are spaced apart in a direction generally parallel to the length of an undrawn bowstring so that the shim serves to increase the effective length of the bow relative to its length when the limbs are fixed directly to the handle.

* * * * *